US008708747B2

(12) United States Patent
Leroyer et al.

(10) Patent No.: US 8,708,747 B2
(45) Date of Patent: Apr. 29, 2014

(54) ELECTRICAL CONTACT AND CONNECTOR ASSEMBLY WITH A LARGE NUMBER OF OPERATIONS

(75) Inventors: Serge Leroyer, Le Mans (FR); Pascal Ribeau, Le Mans (FR)

(73) Assignee: Souriau, Versailles (FR)

( * ) Notice: Subject to any disclaimer, the term of this patent is extended or adjusted under 35 U.S.C. 154(b) by 0 days.

(21) Appl. No.: 13/401,873

(22) Filed: Feb. 22, 2012

(65) Prior Publication Data

US 2012/0214346 A1 Aug. 23, 2012

(30) Foreign Application Priority Data

Feb. 22, 2011 (FR) ..... 11 51442

(51) Int. Cl.
*H01R 13/40* (2006.01)

(52) U.S. Cl.
USPC ..... 439/625

(58) Field of Classification Search
USPC ..... 439/625, 824, 482, 700, 744; 361/761, 361/758
See application file for complete search history.

(56) References Cited

U.S. PATENT DOCUMENTS

| | | | | |
|---|---|---|---|---|
| 1,392,558 | A * | 10/1921 | Darrah et al. | 307/9.1 |
| 6,861,862 | B1 | 3/2005 | Tate | |
| 2004/0012402 | A1 | 1/2004 | Sinclair | |
| 2005/0130507 | A1 | 6/2005 | Arai et al. | |

FOREIGN PATENT DOCUMENTS

EP 0 462 706 12/1991

OTHER PUBLICATIONS

French Search Report dated Sep. 23, 2011, corresponding to the Foreign Priority Application No. 11 51442.

* cited by examiner

*Primary Examiner* — Alexander Gilman
(74) *Attorney, Agent, or Firm* — Young & Thompson

(57) ABSTRACT

A mobile electric contact includes:

a casing (51) in which there is mounted a mobile piston (58) providing an electrical connection and/or disconnection, a split sleeve (52) including a base (53) terminated by at least two lips (54), the piston being mounted slidingly between the two lips (54) of the split sleeve, characterized in that the casing (51) includes a first cavity (512) within which there is fixed the split sleeve (52), and a second cavity (511) within which there is placed a device (56) for shifting the mobile piston.

15 Claims, 3 Drawing Sheets

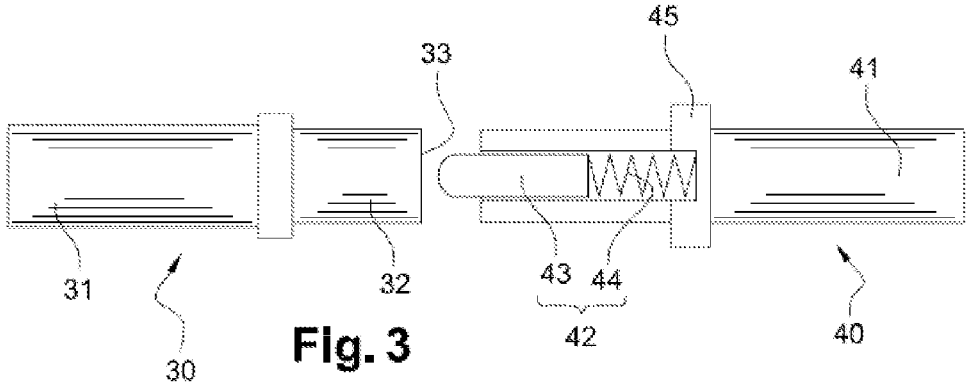
Fig. 3
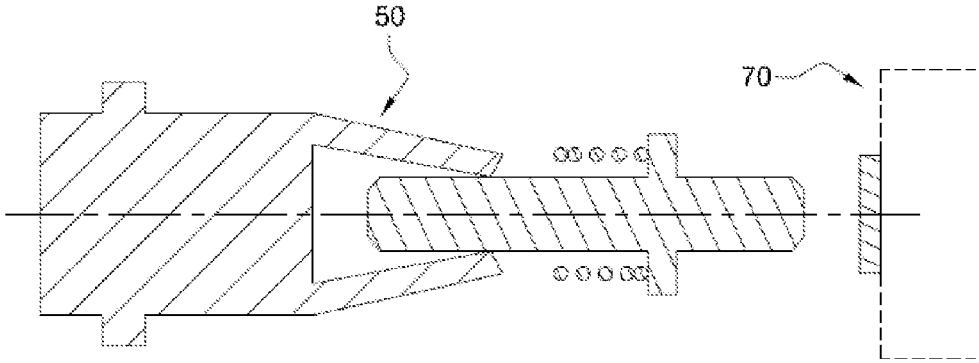
Fig. 4a
Fig. 4b
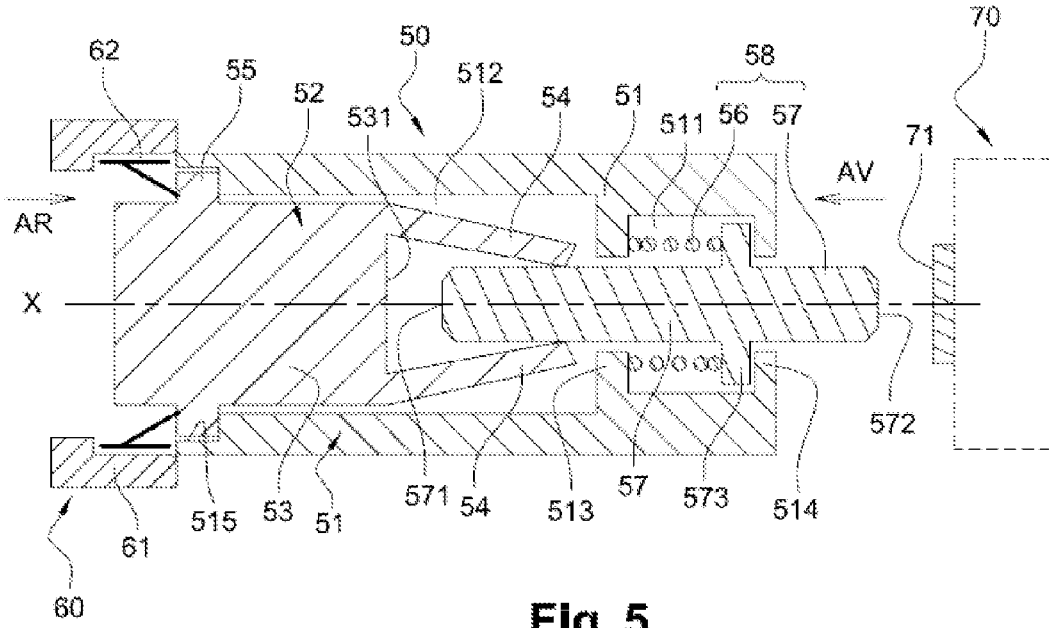
Fig. 5

ELECTRICAL CONTACT AND CONNECTOR ASSEMBLY WITH A LARGE NUMBER OF OPERATIONS

FIELD OF THE INVENTION

The invention pertains to an electrical contact enabling the conduction of an electrical current of high intensity, with a large number of operations. The invention also pertains to a connector assembly comprising an electrical contact of this kind.

The invention can be applied in many technical fields such as that of electronic connection systems. It finds particular application in the aeronautics and automobile fields for setting up provide electrical power connections between two electrical systems.

PRIOR ART

In the field of connection systems, it is sometimes necessary, especially for uses in the aeronautics and automobile sectors, to carry out the conduction of high-intensity currents. To this end, there are connector assemblies enabling the conduction of a current of an intensity of over 50 amperes. These connector assemblies generally provide for a wide zone of contact between the male contact pin or pins and the female contact pin or pins.

One of these connector assemblies which is suited to conducting such high-intensity current is shown in FIG. 1. This connector assembly known as a split sleeve connector assembly has a female electrical contact 20 comprising a support 21 to which a sleeve 22 is fixed. This sleeve 22 is mounted in a protection casing 25. This sleeve 22 is a split sleeve having a base 23 and at least two lips 24. Each lip 24 consists of a strip made of an electrically conductive material with a rounded end. Each lip forms a leaf spring directed towards the central zone of the electrical contact 20. The set of lips 24 is thus capable of keeping an element in the centre of the female contact.

The connector assembly of FIG. 1 also has a male electrical contact 10. This male electrical contact 10 has a support 11 and a pin 12. The pin 12 is a cylindrical rod made out of electrically conductive material, having dimensions adapted to the space offered by the lips 24 of the female electrical contact 20. The pin 12 is designed to be inserted between the lips of the female contact to provide for electrical conduction with said lips.

The lips 24 of the female contact are thus adapted to receiving the pin 12 of the male contact and providing electrical conduction with said pin. However, during the insertion of the pin 12 of the male contact 10 into the split sleeve 22, the pin rubs on each of the lips 24 to spread said lips apart and get inserted between these lips. When the lips 24 are moved away from the sleeve, a localized stress is caused, resulting in wear and tear on the pin 12. FIGS. 2A, 2B and 2C show the different phases of contact between the upper lip 24*a* of the female contact and the pin 12 of the male contact. FIG. 2D shows the force curves corresponding to the pin when it is being introduced into the female contact and the force curve of this pin when it is being removed from the female contact. As can be seen in these figures, the friction is the maximum when the lips are spread apart, i.e. at the instant when the pins come into contact with the lips to spread the lips apart (point A in FIG. 2). However, once the peak of introduction has passed, the pin 12 slides along the lips 24 with reduced friction.

It will be understood that the instant of the spreading apart of the lips, along with the friction of the pin against the lips, induces major wear and tear on the pin whereas the wear and tear is less substantial once the lips are spread apart and the pin slides in.

It can be deduced therefrom that this insertion of the pin into the split sleeve has the direct consequence of wearing out the surfaces of the pin. Consequently, the number of possible operations, i.e. the number of insertions/extractions, for a connector assembly of this kind is of the order of 500 operations. Beyond 500 operations, the male contact at least has to be changed as electrical conduction can no longer be properly carried out when the pin is excessively worn out.

Furthermore, there are connector assemblies in which the number of operations can be great, for example greater than 10,000 operations because the male contact and the female contact can be put into contact with each other without friction. This is the case especially for connector assemblies known as "piston" sets. An example of such a connector assembly is shown in FIG. 3.

In such a connector assembly, the male contact 30 has a support 31 and a connection element 32 having a contact surface 33 designed to ensure conduction with the female contact 40.

The female contact 40 has a support 41 as well as a piston 42. The piston 42 has a mobile pin 43 driven in motion by a shifting device 44. The shifting device 44 is generally a spring inserted between the wall 45 of the support 41 and the mobile pin 43. In a connector of this kind, the spring 44 has a role of an electrical conductor. The electrical conduction between the male contact 30 and the female contact 40 is done by means of the contact surface 33 of the pin 43 and of the spring 44. Now, the surface of contact 33 is relatively flat. Thus, when the male element 30 and the female element 40 are connected, the contact between the pin 43 and the contact surface 33 is obtained without friction. There is therefore no wear and tear or little wear and tear of the pin 43. However, since the electrical conduction goes through the spring 44, the intensity of the current conducted cannot be high. A connector assembly of this kind therefore enables only the passage of low-intensity currents, i.e. currents of an intensity generally below 10 amperes.

SUMMARY OF THE INVENTION

The invention is aimed precisely at overcoming the drawbacks of the techniques referred to here above. To this end, the invention proposes a connector assembly enabling both the conduction of a current of high intensity, of over 50 amperes, and a large number of operations, i.e. more than 10,000 operations. To this end, the invention proposes a female contact comprising a split sleeve permanently receiving a piston. It also proposes a connector assembly comprising a female contact of this kind.

More specifically, the invention pertains to an electrical contact comprising a casing in which there is mounted a piston providing for an electrical connection and/or disconnection, characterized in that it furthermore comprises, in the casing, a female contact with split sleeve comprising a base terminated by at least two lips, and in that the piston is mounted slidingly between the lips of the split sleeve.

Since this piston is permanently placed in the split sleeve, there is no friction of the piston on the sleeve generated by an insertion of said piston between the lips and the sleeve, and this prevents the wearing out of the piston.

The invention also pertains to a connector assembly characterized by the fact it comprises a mobile electrical contact as mentioned here above and a fixed electrical contact, capable of coming into contact with one another to provide for electrical conduction.

Such a connector assembly enables the conduction of a high-intensity current, while having a service life greater than 10,000 operations.

The connector assembly of the invention may comprise one or more of the following characteristics:

- the mobile piston comprises a pin comprising an external end capable of coming into contact with the fixed electrical contact and a shifting device mounted at least partially around the pin to provide for the sliding of the pin between the lips of the split sleeve.
- the casing of the mobile electrical contact comprises a first cavity within which the split sleeve is fixed, and a second internal cavity within which the device for shifting said piston is placed, the pin of the piston being capable of shifting through the first and the second cavities.
- the pin is a cylindrical rod provided with a radial protrusion, said radial protrusion being placed in the second cavity of the casing to obtain a limiting of the shifting of the pin.
- the device for shifting the piston is a spring mounted around the pin, capable of being compressed in the second cavity of the casing by the radial protrusion of the pin.
- the fixed electrical contact has at least one flat connection zone, capable of coming into contact with the extreme end of the pin.
- the mobile electrical contact has means for retaining the sleeve within the first cavity of the casing.
- the retention means comprise a holding ring fixed to the casing at a rear end of the mobile electrical contact, and retaining clips mounted on said ring.

BRIEF DESCRIPTION OF THE DRAWINGS

FIG. 3, already described, represents a connector/piston set according to a second example of the prior art.

FIGS. 4A and 4B schematically represent a mobile contact and a fixed contact in a connector assembly according to the invention.

FIG. 5 represents a schematic view in section of the mobile contact of a connector assembly according to the invention.

DETAILED DESCRIPTION OF EMBODIMENTS OF THE INVENTION

The connector assembly of the invention has a mobile contact 50 and a fixed contact 70 as can be seen in FIGS. 4*a* and 4*b*. The contact 50 is called a mobile contact because the internal elements that provide for the electrical connection are mobile as shall be explained in greater detail here below. As opposed to the mobile contact, the contact 70 is called a fixed contact, because the elements that provide for the electrical connection are fixed.

Figure 1:
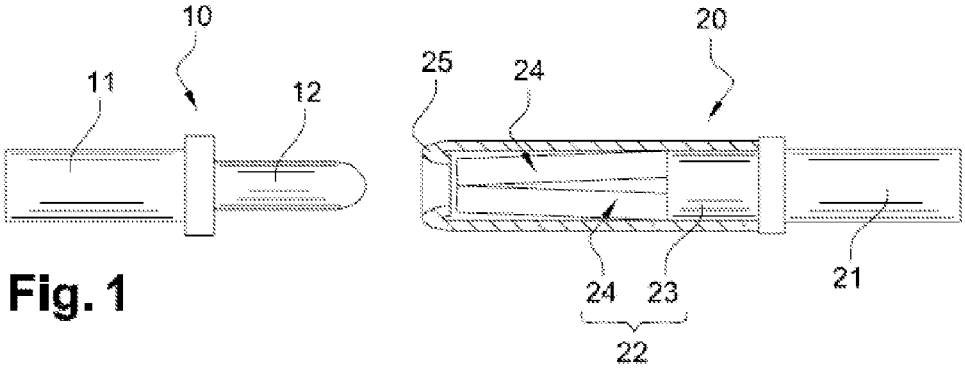
FIG. 1, already described, represents a connector assembly with a split sleeve according to a first example of the prior art.
Figure 2A:
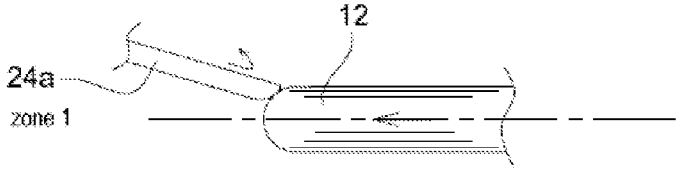
FIGS. 2A to 2C, already described, represent details of FIG. 1 during the connection of the male and female contacts.
Figure 2B:
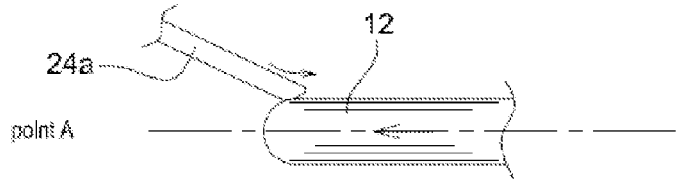
Figure 2C:
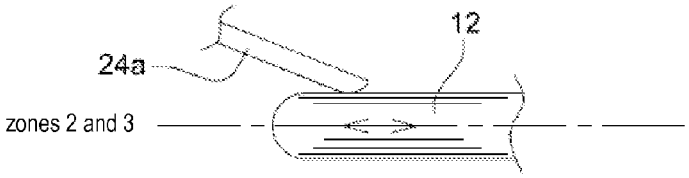
Figure 2D:
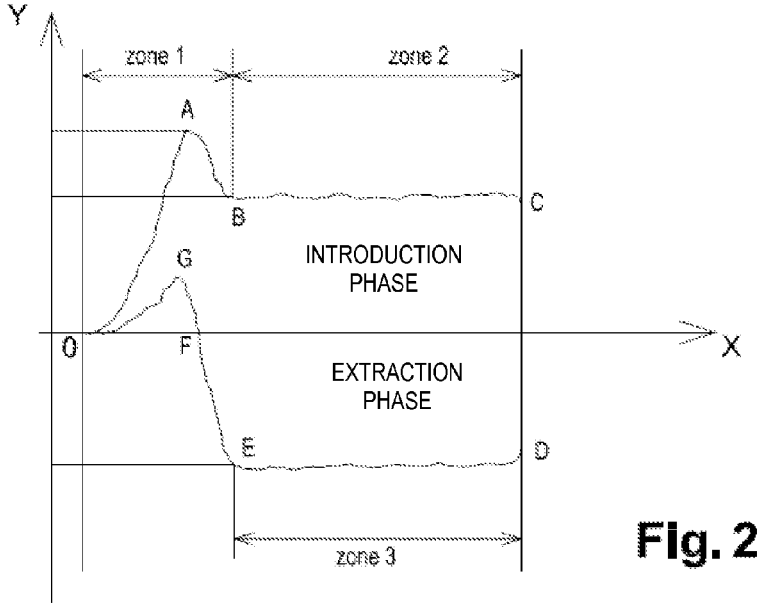
FIG. 2D, already described, represents stress curves obtained during the connection of the male and female contacts of FIG. 1.
Figure 6:
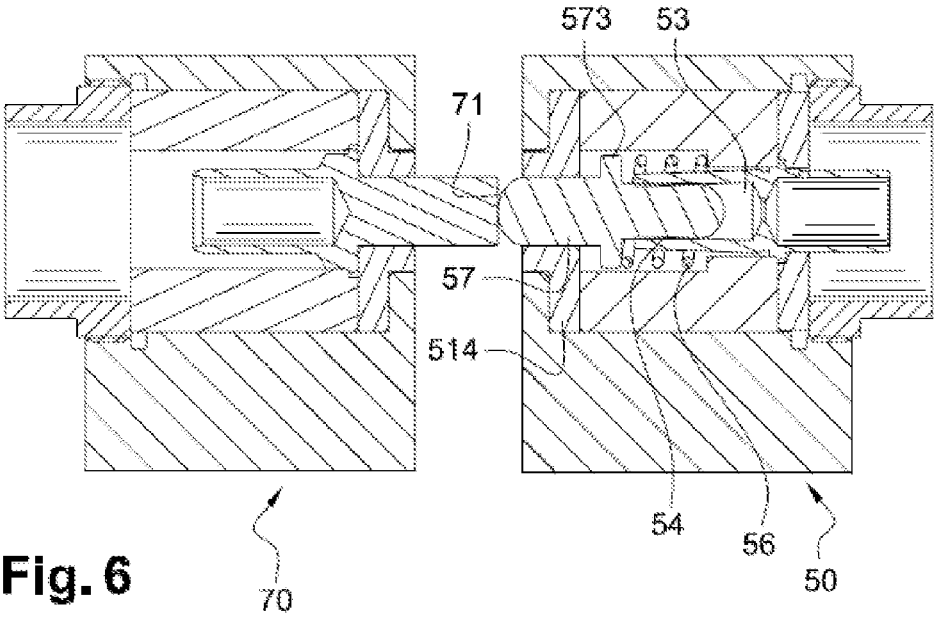
FIG. 6 represents a side view of the connector assembly according to the invention.

The mobile contact 50 is shown in a cross-section view in FIG. 5. This mobile contact 50 is shown in a casing 51 made out of an electrically insulating material and is at least partially constituted by at least one female contact with a split sleeve 52 of the prior art type. This female contact with split sleeve, more simply called a split sleeve 52, comprises a base 53 bearing several lips 54. This base 53 is a substantially cylindrical element with a length adapted to the dimensions of the casing 51. This base 53 is terminated at its internal end, i.e. at its end pointing towards the fixed contact 70, by lips 54. The zone of the base 53 situated between the lips 54 is called an inter-lip zone 531. This inter-lip zone can be flat, as shown in FIG. 5 or incurvated as shown in FIG. 6. The base 53 as well as the lips 54 are made out of an electrically conductive material. In the example of FIG. 5, the split sleeve has two lips 54. Each of these lips 54 has the form of a strip pointed towards the central axis X of the mobile contact. These strips 54 are generally made by machining a base 53 in such a way that each of them forms a leaf spring capable of fulfilling such a contact with an element laid out along the axis X.

The mobile contact 50 also has a piston 58 mounted in the casing 51. This piston 58 has a pin 57 and a shifting device 56. The shifting device 56 is mounted partially around the pin 57 to provide for the shifting of said pin 57 within the casing 51. The pin 57 is a rod, for example cylindrical, made out of an electrically conductive material. This pin 57 is capable of sliding inside the casing, at least partially, between the lips 54 of the split sleeve. It is capable, under certain conditions which shall be described further below, of coming into contact with the inter-lip zone 351. The shifting device can also be a spring mounted around a part of the pin 57 to provide for the sliding of said pin 57.

The casing 51 of the mobile contact 50 has two cavities: a first cavity 512 in which the split sleeve 52 is set up and a second cavity 511 in which the shifting device 56 is mounted. The first cavity 512 has a diameter adapted to the dimension of the sleeve 52. The second cavity 511 has a diameter adapted to the external outline of the shifting device 56. The second cavity 511 can have a diameter smaller than that of the first cavity 512. The second cavity 511 is partially closed by an external radial wall 514 and an internal radial wall 513. The external wall 514, situated so as to be facing the fixed contact 70, is the exit face of the mobile contact 50. The internal wall 513 forms a wall of separation with the first cavity 512. These two external and internal walls each have a hole at their centre for the passage of the pin.

Preferably, the casing 51 is made out of an insulator material. It can be obtained by molding. This casing 51 can be made with several assembled parts in order to facilitate the assembly of the different elements of the mobile contact 50.

The shifting device 56 is mounted around the pin 57, in the second cavity, between the two radial walls 513 and 514.

The pin 57 has a length greater than the distance situated between the inter-lip zone 531 of the sleeve and the front face AV of the mobile contact. In this way, the pin goes through the second cavity 511 from one side to the other, from the front face AV of the mobile contact up to the first cavity 512 between the lips 54 of the sleeve. The pin 57 has an internal end 571 situated so as to be facing the inter-lip zone 531 of the base 53 of the sleeve and an external end 572 designed to come into contact with the fixed contact 70. The external end 572 of the pin opens onto the front face AV of the mobile contact 50, facing a connection zone 71 of the fixed contact 70. When the external end 572 of the pin 57 is in contact with the connection zone 71 of the fixed contact 70, the electrical connection is set up, since the lips 54 of the sleeve 52 are in permanent contact with the pin 57. When the mobile contact 50 and the fixed contact 70 are connected with each other, the internal end 571 of the pin 57 comes into contact with the inter-lip zone 531 of the split sleeve 52, further increasing the zone of contact between the pin 57 and the split sleeve 52, thus enabling the passage of relatively high-intensity currents.

In FIG. 5, dashed lines show the fixed contact 70 with its flat connection zone 71 designed to come into contact with the pin 57 of the mobile contact 50.

To ensure this electrical contact, the pin 57 slides within the casing through the shifting device 56. However, one part of the pin 57 situated in the first cavity 512 is permanently installed between the lips 54 of the sleeve. Thus, whatever the shift of the pin in the casing, this portion of said pin remains between the lips of the sleeve, preventing localized friction due to the introduction of the pin between the lips.

The pin 57 has a radial protrusion 573 on at least one part of its contour. This protrusion 573 forms a skirt around the rod of the pin, with a diameter greater than that of the hole of the external wall 514 of the casing. This protrusion 573 is placed on that part of the rod situated in the second cavity 511. It has the role firstly of retaining the pin 57 within the casing 51 and secondly of compressing the shifting device 56 within the second cavity. It can thus be understood that, in a connected position, the protrusion 573 compresses the spring 56 of the shifting device and, in a disconnected position, the spring 56 is decompressed so that the radial protrusion 573 retains the pin 57.

It can be understood from the above that, when the mobile contact 50 and the fixed contact 70 are disconnected from each other, the external end 572 of the pin 57 is disconnected from the flat connection zone 71 of the fixed contact. The pin 57 is then pushed back by the shifting means 56 in the forward direction AV, while maintaining electrical contact between the internal end 571 of the pin and the inter-lip zone 531 of the split sleeve.

On the contrary, when the fixed contact 70 and the mobile contact 50 are connected to each other, the flat connection zone 71 of the fixed contact pushes the pin 57 in the rear direction AR, i.e. towards the base 53 of the sleeve. The electrical contact between the split sleeve 52 and the flat connection zone 71 of the fixed contact is obtained by means of the piston 58.

FIG. 6 shows an example of a connector assembly according to the invention when the mobile contact 50 is connected with the fixed contact 70.

It follows from the above that, at each time that the two fixed and mobile contacts are connected up, the pin 57 comes into contact with the flat connection zone 70 and, as and when the connection takes place, the pin retreats in the casing 51 and slides between the lips 54 without breaking electrical contact. There is therefore no peak of friction between the pin and the lips since there is insertion of the pin between the lips, the pin being placed permanently between said lips of the split sleeve. Only the point of contact between the pin and the lips varies according to the connection travel.

A connector assembly of this kind ensures a passage of high current of over 50 amperes. Furthermore, it offers low wear and tear of the pin and of the lips since the pin is permanently between the lips of the split sleeve.

In a preferred embodiment of the invention, the mobile contact can be detachable. In this case, the mobile contact 50 can comprise means 60 for retaining the slot within the casing 51 as seen in FIG. 5. These retaining means 60 hold the sleeve in the casing 51 when the mobile contact can be detached.

In this embodiment, the casing 51 is open on its rear face AR to enable the insertion and extraction of the slot in the first cavity 512. In this case, the base 53 of the slot may comprise a flange ring 55 capable of getting inserted into a housing 515 situated in the rear of the casing 51. The retaining means 60 make it possible to longitudinally block the flange ring 55 in the housing 515 when the mobile contact is mounted. It furthermore makes it possible to unblock the flange ring 55 from the housing 515 when the mobile contact has to be dismounted.

Figure 7:
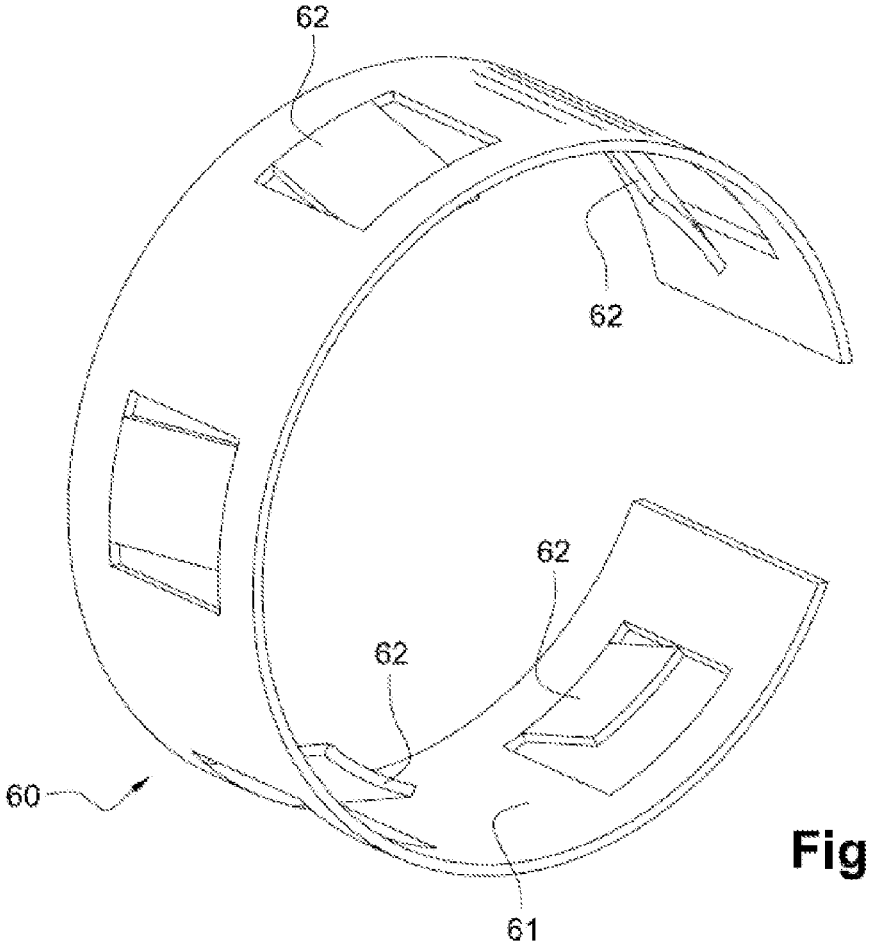
FIG. 7 represents a device for retaining the sleeve of the connector assembly according to the invention.

One example of retaining means is shown in FIG. 7. In this example, the retaining means 60 comprise a retaining ring 61 fixed to the rear end of the casing 51, for example mounted so as to be free or force-fitted. This retaining ring 61 is provided with a plurality of clips 62 oriented towards the interior of said ring 61 (towards the axis X). These clips 62 are holding lugs each blocking the collar 55 of the sleeve. When the sleeve is in a mounted position, the ring 61 is fixed to the casing and the clips 62 rest on the flange ring 55 of the sleeve. To dismount the sleeve, a tool can be used to press on the clips so as to bring them close to the ring and thus unblock the ring 55 from the sleeve. The sleeve can then be made to slide outside the casing 51.

The invention claimed is:

1. An electrical contact, comprising:

a casing in which a mobile piston configured to provide an electrical connection and/or disconnection is mounted; and a female contact disposed in the casing, the female contact having a split sleeve comprising a base terminated by at least two lips, and in that the mobile piston being mounted slidingly between the two lips of the split sleeve, wherein the casing comprises a first cavity within which the split sleeve is fixed, and a second cavity within which a shifting device configured to shift the mobile piston is disposed, the second cavity being partially closed by an external radial wall and an internal radial wall forming a wall separation with the first cavity.

2. The electrical contact according to claim 1, wherein the internal radial wall extends inwardly toward a central portion of the casing between the first cavity and the second cavity to form the wall separation between the first cavity and the second cavity.

3. A connector assembly, comprising:

the mobile electrical contact according to claim 1; and a fixed electrical contact configured to come into contact with the mobile electrical contact to provide for electrical conduction.

4. The connector assembly according to claim 3, wherein the mobile electrical contact has means for retaining the sleeve within the first cavity of the casing.

5. The connector assembly according to claim 4, wherein the retention means comprises:

a holding ring fixed to the casing at a rear end of the mobile electrical contact, and retaining clips mounted on the ring.

6. The connector assembly according to claim 3, wherein the mobile piston comprises a pin configured to shift through the first and the second cavities of the casing, the pin comprising an external end configured to come into contact with the fixed electrical contact, and the shifting device configured to shift the mobile pin is mounted at least partially around the pin to provide for the sliding of the pin between the lips of the split sleeve.

7. The connector assembly according to claim 6, wherein the mobile electrical contact has means for retaining the sleeve within the first cavity of the casing.

8. The connector assembly according to claim 6, wherein the fixed electrical contact has a flat connection zone configured to come into contact with the external end of the pin.

9. The connector assembly according to claim 8, wherein the mobile electrical contact has means for retaining the sleeve within the first cavity of the casing.

10. The connector assembly according to claim 6, wherein the pin is a cylindrical rod provided with a radial protrusion, the radial protrusion being disposed in the second cavity of the casing to obtain a limiting of the shifting of the pin.

11. The connector assembly according to claim 10, wherein the fixed electrical contact has a flat connection zone configured to come into contact with the external end of the pin.

12. The connector assembly according to claim 10, wherein the mobile electrical contact has means for retaining the sleeve within the first cavity of the casing.

13. The connector assembly according to claim 10, wherein the shifting device configured to shift the piston is a spring mounted around the pin, the spring being configured to be compressed in the second cavity of the casing by the radial protrusion of the pin.

14. The connector assembly according to claim 13, wherein the fixed electrical contact has a flat connection zone configured to come into contact with the external end of the pin.

15. The connector assembly according to claim 2, wherein the mobile electrical contact has means for retaining the sleeve within the first cavity of the casing.

* * * * *